US008977178B2

(12) United States Patent
Suzuki et al.

(10) Patent No.: US 8,977,178 B2
(45) Date of Patent: Mar. 10, 2015

(54) FIXING DEVICE

(71) Applicants: Noboru Suzuki, Komaki (JP); Kei Ishida, Nagoya (JP); Takuji Matsuno, Ichinomiya (JP)

(72) Inventors: Noboru Suzuki, Komaki (JP); Kei Ishida, Nagoya (JP); Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 44 days.

(21) Appl. No.: 13/755,720

(22) Filed: Jan. 31, 2013

(65) Prior Publication Data

US 2013/0195527 A1 Aug. 1, 2013

(30) Foreign Application Priority Data

Jan. 31, 2012 (JP) ..... 2012-018022

(51) Int. Cl.
*G03G 15/20* (2006.01)

(52) U.S. Cl.
CPC ..... *G03G 15/2089* (2013.01); *G03G 15/2017* (2013.01); *G03G 15/2053* (2013.01); *G03G 15/2085* (2013.01); *G03G 2215/2035* (2013.01)
USPC ..... 399/329

(58) Field of Classification Search
CPC ..... G03G 15/2053; G03G 2215/2035
USPC ..... 399/328, 329
See application file for complete search history.

(56) References Cited

U.S. PATENT DOCUMENTS

| | | | | |
|---|---|---|---|---|
| 5,148,226 | A * | 9/1992 | Setoriyama et al. | 399/329 |
| 6,266,510 | B1 * | 7/2001 | Curry et al. | 399/329 |
| 2007/0147915 | A1 * | 6/2007 | Kishino et al. | 399/329 |
| 2011/0150544 | A1 * | 6/2011 | Ishida et al. | 399/328 |

* cited by examiner

*Primary Examiner* — Gregory H Curran
(74) *Attorney, Agent, or Firm* — Banner & Witcoff, Ltd.

(57) ABSTRACT

A fixing device including: a flexible cylindrical member; a heater that is disposed inside the cylindrical member; a nip plate configured to be in contact with an inner peripheral surface of the cylindrical member and is configured to be heated by the heater; and a roller configured to pinch the cylindrical member between the roller and the nip plate, wherein, at least during fixing, the nip plate has a curved shape where a central portion thereof in an axial direction of the cylindrical member is more spaced from the roller than both end portions thereof in the axial direction, and wherein the roller is a concave roller where a diameter of a central portion thereof in the axial direction is smaller than diameters of both end portions thereof respectively.

18 Claims, 6 Drawing Sheets

FIXING DEVICE

CROSS-REFERENCE TO RELATED APPLICATIONS

This application claims priority from Japanese Patent Application No. 2012-018022 filed on Jan. 31, 2012, the entire contents of which are incorporated herein by reference.

TECHNICAL FIELD

Aspects of the invention relate to a fixing device for heat-fixing a developer image transferred to a recording sheet.

BACKGROUND

In related art, a fixing device that is used for an image forming apparatus of an electrophotographic type has been known which has a cylindrical member, a ceramic heater, a heater frame and a backup roller (for example, refer to U.S. Pat. No. 6,266,510). The ceramic heater is disposed to slidingly contact an inner peripheral surface of the cylindrical member and is configured to heat the cylindrical member. The backup roller has a straight shape and pinches the cylindrical member between the ceramic heater and the backup roller. Also, the heater frame is disposed at one side of the backup roller opposite to another side of the nip plate where the backup roller is provided and supports the heater frame.

In the fixing device, a part of the heater frame facing the backup roller has a curved concave shape so that a central portion thereof in an axial direction of the cylindrical member is more spaced from the backup roller than both end portions thereof in the axial direction. Thereby, upon the fixing, when both end portions of the heater frame in the axial direction are pressed towards the backup roller, a pressure that is applied between the ceramic heater and the backup roller becomes higher at both end portions in the axial direction than at the central portion. Therefore, a conveying speed of a recording sheet, which is conveyed through between the cylindrical member and the backup roller, becomes faster at both end portions of the recording sheet, so that a central portion of the recording sheet is tensioned towards both end portions thereof. Thereby, it is possible to reduce wrinkles being generated on the recording sheet.

According to the above-described fixing device, however, only the heat frame has the concave shape, that is, the backup roller has the straight shape. Therefore, in order to make the above-described difference in pressures applied between the ceramic heater and the backup roller appropriate, an amount of depression of the heater frame needs to be made large. However, when the amount of depression of the heater frame is large, it is difficult to keep the cylindrical member straight during operation.

SUMMARY

Accordingly, an object of the invention is to provide a fixing device capable of reducing wrinkles from being generated on a recording sheet while keeping a cylindrical member straight.

According to an aspect of the present invention, there is provided a fixing device including: a flexible cylindrical member; a heater; a nip plate; and a roller. The heater is disposed inside the cylindrical member. The nip plate is configured to be in contact with an inner peripheral surface of the cylindrical member and is configured to be heated by the heater. The roller is configured to pinch the cylindrical member between the roller and the nip plate. At least during fixing, the nip plate has a curved shape where a central portion thereof in an axial direction of the cylindrical member is more spaced from the roller than both end portions thereof in the axial direction. The roller is a concave roller where a diameter of a central portion thereof in the axial direction is smaller than diameters of both end portions thereof respectively.

According to the fixing device configured as described above, compared to a configuration where only the nip plate is formed to have a concave shape and the backup roller has a straight shape, it is possible to reduce an amount of depression of the nip plate. Thereby, it becomes more easy to keep the cylindrical member, which is pinched between the nip plate and the backup roller, straight. Also, during fixing, a pressure that is applied between the nip plate and the backup roller becomes higher at both end portions in the axial direction than at the central portion. Therefore, the recording sheet is tensioned towards both end portions thereof in the axial direction, so that wrinkles are difficult to be generated on a central portion of the recording sheet in the axial direction.

According to another aspect of the invention, there is provided a thermal fixing device including: an endless belt; a nip plate; and a roller. The endless belt defines a first axial line extending in a first direction. The nip plate is disposed inside the endless belt and includes a central portion in the first direction and first and second end portions in the first direction, the first end portion of the nip plate being an end portion of the nip plate in the first direction and the second end portion of the nip plate being an opposite end portion of the first end portion in the first direction. The roller defines a second axial line and is opposed to an outer surface of the endless belt in a second direction perpendicular to the first direction. The roller is configured to pinch the endless belt between the roller and the nip plate and includes a central portion in the first direction and first and second end portions in the first direction, the first end portion of the roller being an end portion of the roller in the first direction and the second end portion of the roller being an opposite end portion of the first end portion in the first direction. The nip plate is configured have a curved shape such that a distance between the central portion of the nip plate and the second axial line in the second direction is greater than a distance between the first end portion of the nip plate and the second axial line in the second direction, and the distance between the central portion of the nip plate and the second axial line in the second direction is greater than a distance between the second end portion of the nip plate and the second axial line in the second direction. The roller is a concave roller where a diameter of a central portion of the roller is smaller than a diameter of the first end portion of the roller, and the diameter of the central portion of the roller is smaller than a diameter of the second end portion of the roller.

Here, "the second axial line" may be a central axial line of the roller. Further, "the distance in the second direction" may be a component of the distance in the second direction.

According to another aspect of the invention, there is provided a thermal fixing device including: an endless belt; a nip plate; a heater; and a roller. The endless belt defines a first axial line extending in a first direction. The nip plate is disposed inside the endless belt and includes a central portion in the first direction and an end portion in the first direction. The heater is configured to heat the endless belt. The roller defines a second axial line and is opposed to an outer surface of the endless belt in a second direction perpendicular to the first direction. The roller is configured to pinch the endless belt between the roller and the nip plate and includes a central portion in the first direction and an end portion in the first direction. The nip plate is configured have a curved shape such that a distance between the central portion of the nip plate and the second axial line in the second direction is greater than a distance between the end portion of the nip plate and the second axial line in the second direction. The roller is a concave roller where a diameter of a central portion of the roller is smaller than a diameter of the end portion of the roller.

DETAILED DESCRIPTION

Hereinafter, an illustrative embodiment of the invention will be described in detail with reference to the drawings. Meanwhile, in the following descriptions, a schematic configuration of a laser printer 1 (image forming apparatus) having a fixing device 100 according to an illustrative embodiment of the invention will be first briefly described and then a detailed configuration of the fixing device 100 will be described.

Schematic Configurations of Laser Printer

Figure 1:
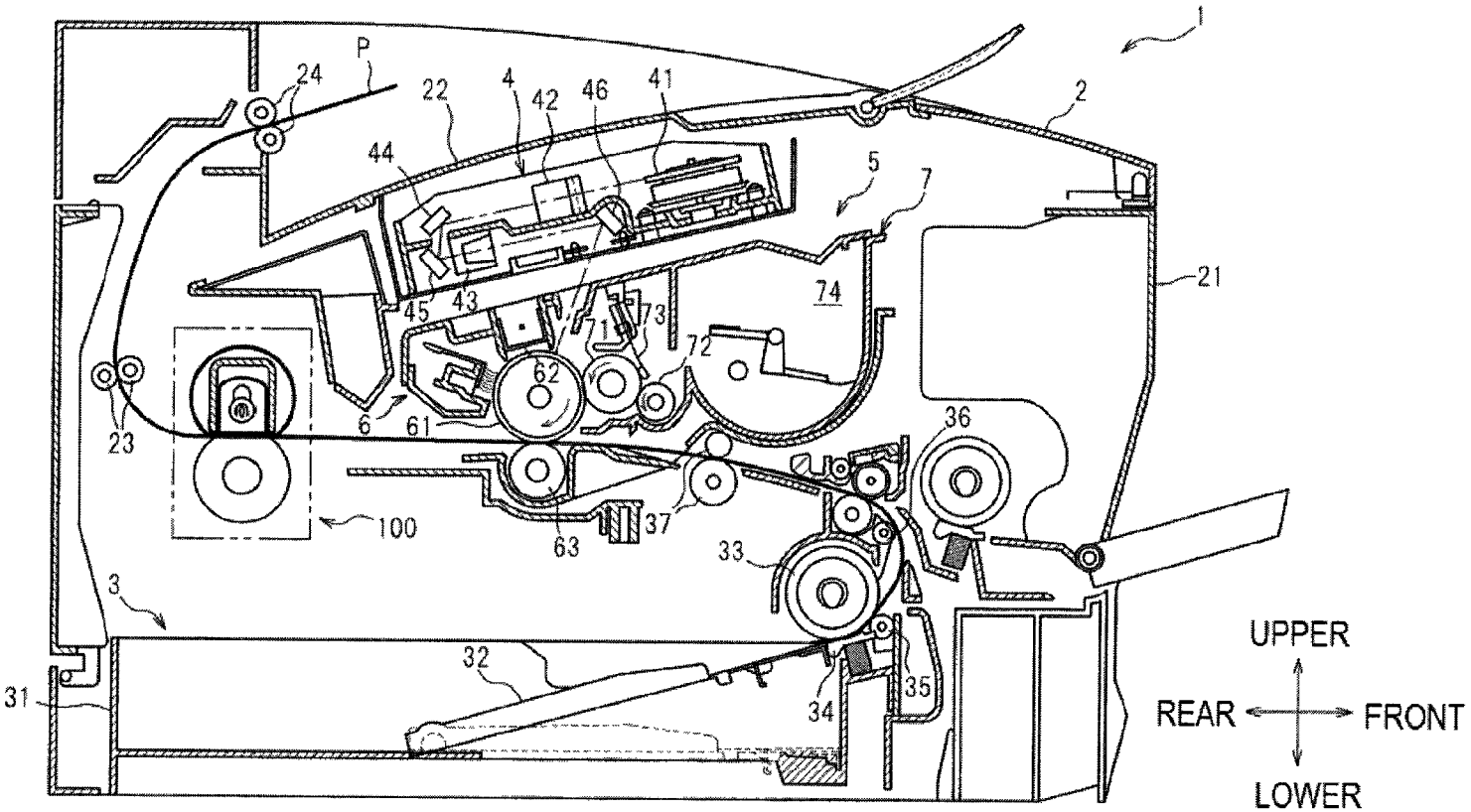
FIG. 1 shows a schematic configuration of a laser printer having a fixing device according to an illustrative embodiment of the invention.

As shown in FIG. 1, the laser printer 1 mainly has, in a body housing 2, a feeder unit 3 that feeds a sheet P, which is an example of the recording sheet, an exposure device 4, a process cartridge 5 that transfers a toner image (developer image) onto the sheet P and a fixing device 100 that heat-fixes the toner image on the sheet P.

Meanwhile, in the following descriptions, the directions are described on the basis of a user who uses the laser printer 1. That is, the right side of FIG. 1 is referred to as the "front side", the left side of FIG. 1 is referred to as the "rear side", the front side of FIG. 1 is referred to as the "left side" and the inner side of FIG. 1 is referred to as the "right side." Also, the upper-lower direction of FIG. 1 is referred to as the "upper-lower direction".

The feeder unit 3 is provided at a lower part in the body housing 2 and mainly has a sheet feeding tray 31 that accommodates therein sheets P, a sheet pressing plate 32 that lifts up a front side of the sheets P, a feeder roller 33, a feeder pad 34, paper dust removing rollers 35, 36 and register rollers 37. The sheets P in the sheet feeding tray 31 are obliquely inclined towards the feeder roller 33 by the sheet pressing plate 32 and are separated one by one by the feeder roller 33 and the feeder pad 34, which is then conveyed towards the process cartridge 5 through the paper dust removing rollers 35, 36 and the register rollers 37.

The exposure device 4 is disposed at an upper part in the body housing 2 and mainly has a laser emitting unit (not shown), a polygon mirror 41 that is rotary driven, lenses 42, 43 and reflectors 44, 45, 46. In the exposure device 4, a laser light (refer to the dotted-dashed line) based on image data, which is emitted from the laser emitting unit, is reflected or passes in order of the polygon mirror 41, the lens 42, the reflectors 44, 45, the lens 43 and the reflector 46 and is then scanned on a surface of a photosensitive drum 61 at high speed.

The process cartridge 5 is disposed below the exposure device 4 and is detachably mounted to the body housing 2 through an opening that is formed when a front cover 21 provided to the body housing 2 is opened. The process cartridge 5 has a drum unit 6 and a developing unit 7.

The drum unit 6 mainly has the photosensitive drum 61, a charger 62 and a transfer roller 63. Also, the developing unit 7 is detachably mounted to the drum unit 6 and mainly has a developing roller 71, a supply roller 72, a layer thickness regulation blade 73 and a toner accommodation unit 74 that accommodates therein toner (developer).

In the process cartridge 5, the surface of the photosensitive drum 61 is uniformly charged by the charger 62 and then exposed by the high-speed scanning of the laser light emitted from the exposure device 4, so that an electrostatic latent image based on the image data is formed on the photosensitive drum 61. Also, the toner in the toner accommodation unit 74 is supplied to the developing roller 71 via the supply roller 72, is introduced between the developing roller 71 and the layer thickness regulation blade 73 and is then carried on the developing roller 71 as a thin layer having a predetermined thickness.

The toner carried on the developing roller 71 is supplied from the developing roller 71 to the electrostatic latent image formed on the photosensitive drum 61. Thereby, the electrostatic latent image becomes visible and a toner image is thus formed on the photosensitive drum 61. Then, the sheet P is conveyed between the photosensitive drum 61 and the transfer roller 63, so that the toner image on the photosensitive drum 61 is transferred onto the sheet P.

The fixing device 100 is arranged at the rear of the process cartridge 5. The toner image (toner) transferred onto the sheet P is heat-fixed on the sheet P as the sheet passes through the fixing device 100. The sheet P having the toner image heat-fixed thereon is discharged onto a sheet discharge tray 22 by conveyance rollers 23, 24.

Detailed Configuration of Fixing Device

Figure 2:
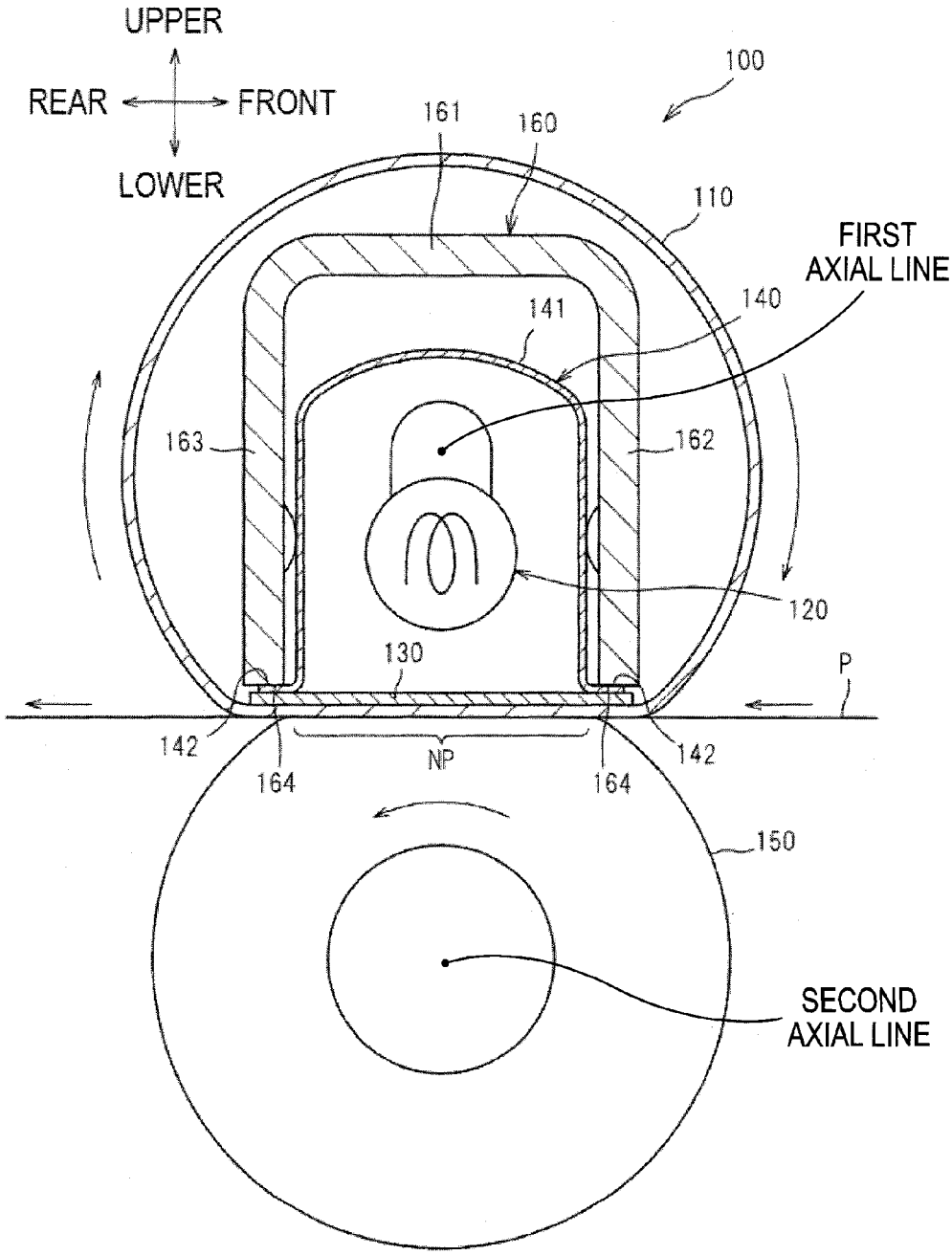
FIG. 2 is a sectional view of the fixing device.
Figure 3:
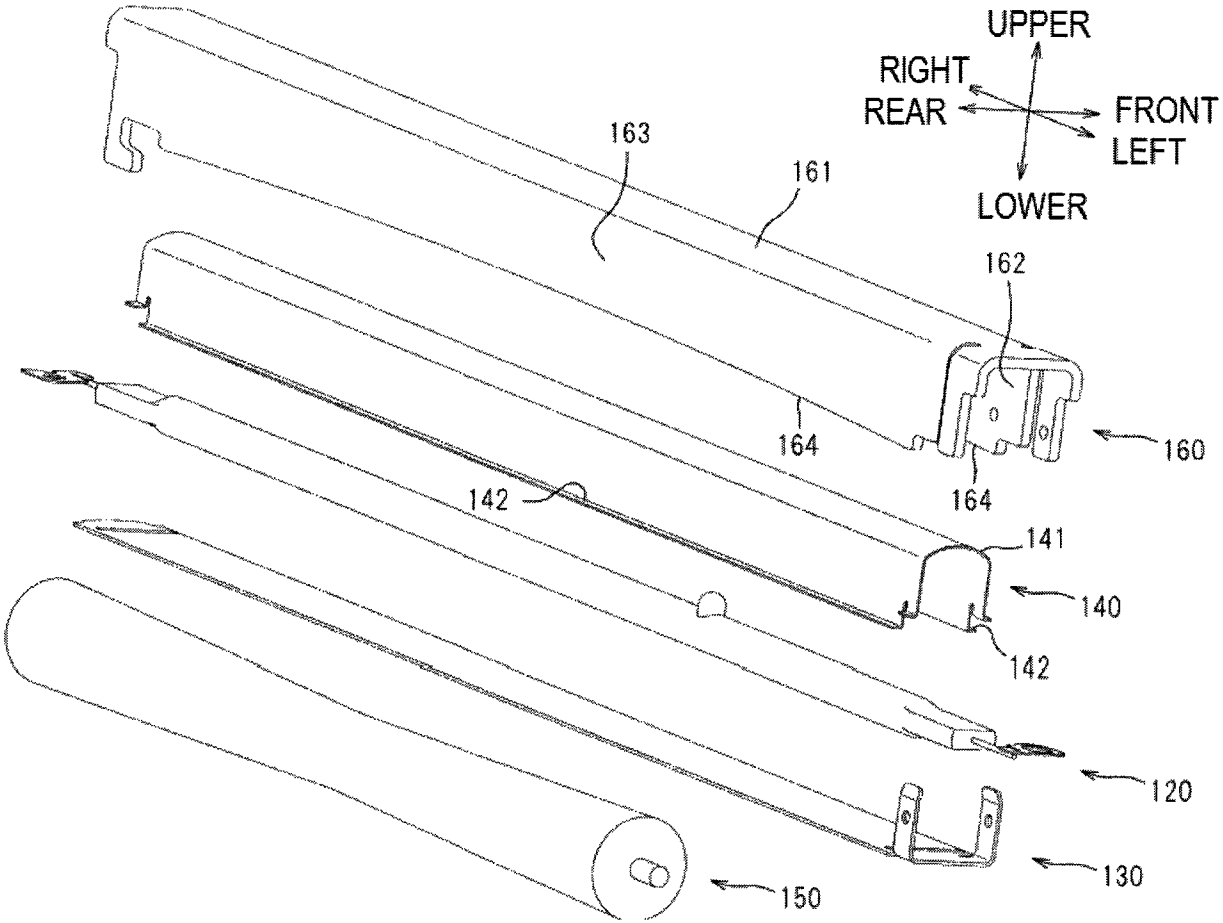
FIG. 3 is a perspective view showing a halogen lamp, a nip plate, a reflection plate, a pressing roller and a stay.

As shown in FIGS. 2 and 3, the fixing device 100 has a fixing belt 110 that is an example of the cylindrical member, a halogen lamp 120 that is an example of the heater, a nip plate 130, a reflection plate 140, a pressing roller 150 that is an example of the backup roller and a stay 160.

The fixing belt 110 is a stainless steel belt of an endless shape (cylindrical shape). The fixing belt 110 has heat resistance and flexibility and rotation thereof is guided at both end portions by a guide member (not shown). The fixing belt 110 has a straight shape having a substantially constant outer diameter in an axial direction of the fixing belt 110, i.e., in the left-right direction.

The halogen lamp 120 is a heating element that heats the nip plate 130 and the fixing belt 110 to thus generate radiation heat heating the toner on the sheet P and is disposed at a predetermined interval from inner sides of the fixing belt 110 and the nip plate 130 at an inside of the fixing belt 110.

The nip plate 130 is a plate-shaped member to which the radiation heat from the halogen lamp 120 is applied, and is disposed to slidingly contact an inner surface of the cylindrical fixing belt 110. The nip plate 130 transfers the radiation heat, which is applied from the halogen lamp 120, to the toner on the sheet P through the fixing belt 110.

The nip plate 130 has a planar shape made of a material having higher thermal conductivity that the steel stay 160, for example, aluminum plate. The nip plate 130 has a thickness that can be deflection-deformed.

The reflection plate 140 is a member that reflects the radiation heat from the halogen lamp 120 (the radiation heat radiated mainly in the front-rear direction or upper direction) toward the nip plate 130 (an upper surface of the nip plate 130). The reflection plate 140 is disposed at a predetermined interval from the halogen lamp 120 so that it surrounds the halogen lamp 120 at the inside of the fixing belt 110, more specifically, between the halogen lamp 120 and the stay 160 that will be described later.

The radiation heat from the halogen lamp 120 is collected to the nip plate 130 by the reflection plate 140. Thereby, it is possible to effectively use the radiation heat from the halogen lamp 120, thereby rapidly heating the nip plate 130 and the fixing belt 110.

The reflection plate 140 is formed by bending a plate such as aluminum plate and the like, which have high reflectance of the infrared light and far-infrared light, into a substantially U shaped section. More specifically, the reflection plate 140 mainly has a reflection part 141 having a bent shape (substantially U shape in a cross-sectional-view) and flange parts 142 that extend from both end portions of the reflection part 131 towards the outside in the front-rear direction and are an example of the supported part. In the meantime, in order to increase the heat reflectivity, the reflection plate 140 may be formed using an aluminum plate and the like for which a mirror finishing has been performed. Although the flange parts 142 have a planar shape, it is possible to perform deflection-deformation, so that the entire reflection plate 140 can be deformed.

The pressing roller 150 is an elastically deformable member and is disposed below the nip plate 130. The pressing roller 150 pinches the fixing belt 110 between the nip plate 130 and the pressing roller 150 at an elastically deformed state.

Figure 4:
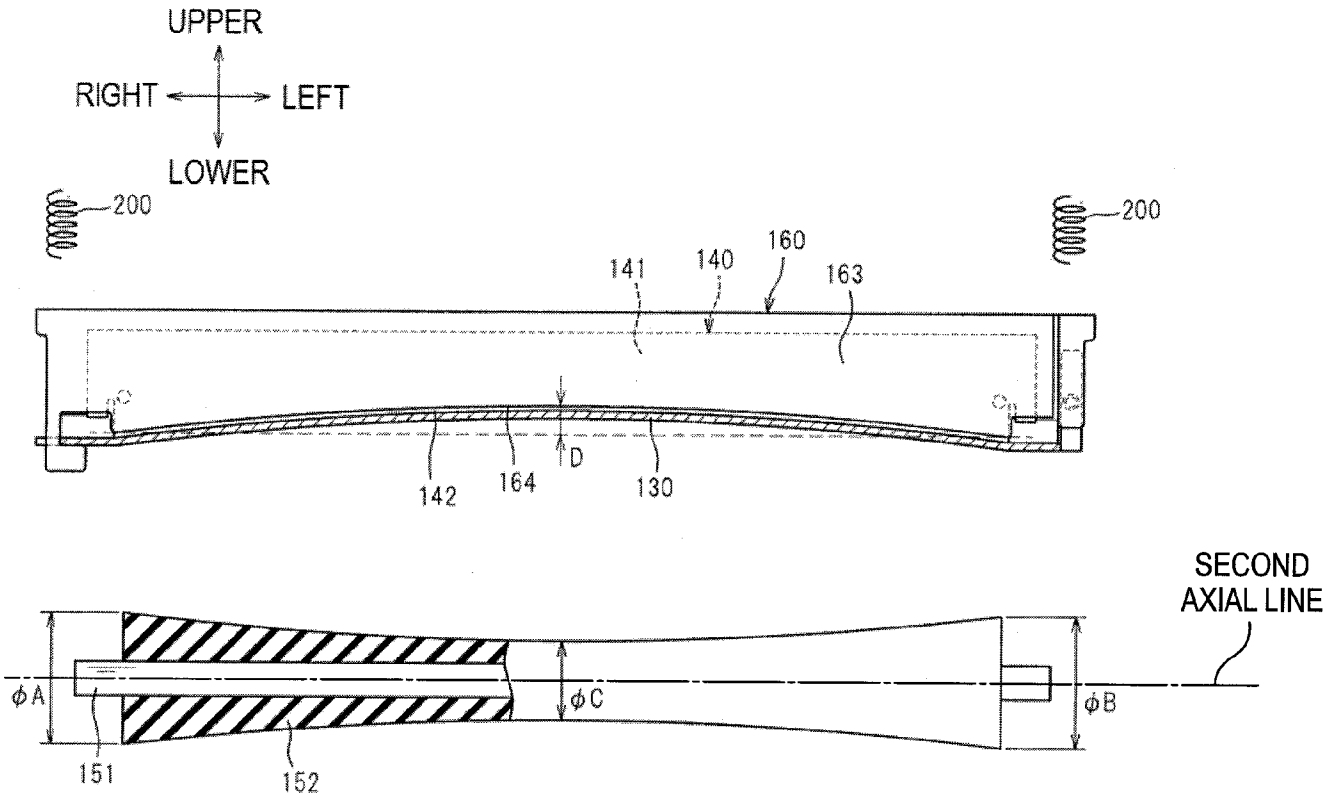
FIG. 4 shows the reflection plate and nip plate mounted on the stay, the pressing roller and urging members.
Figure 5:
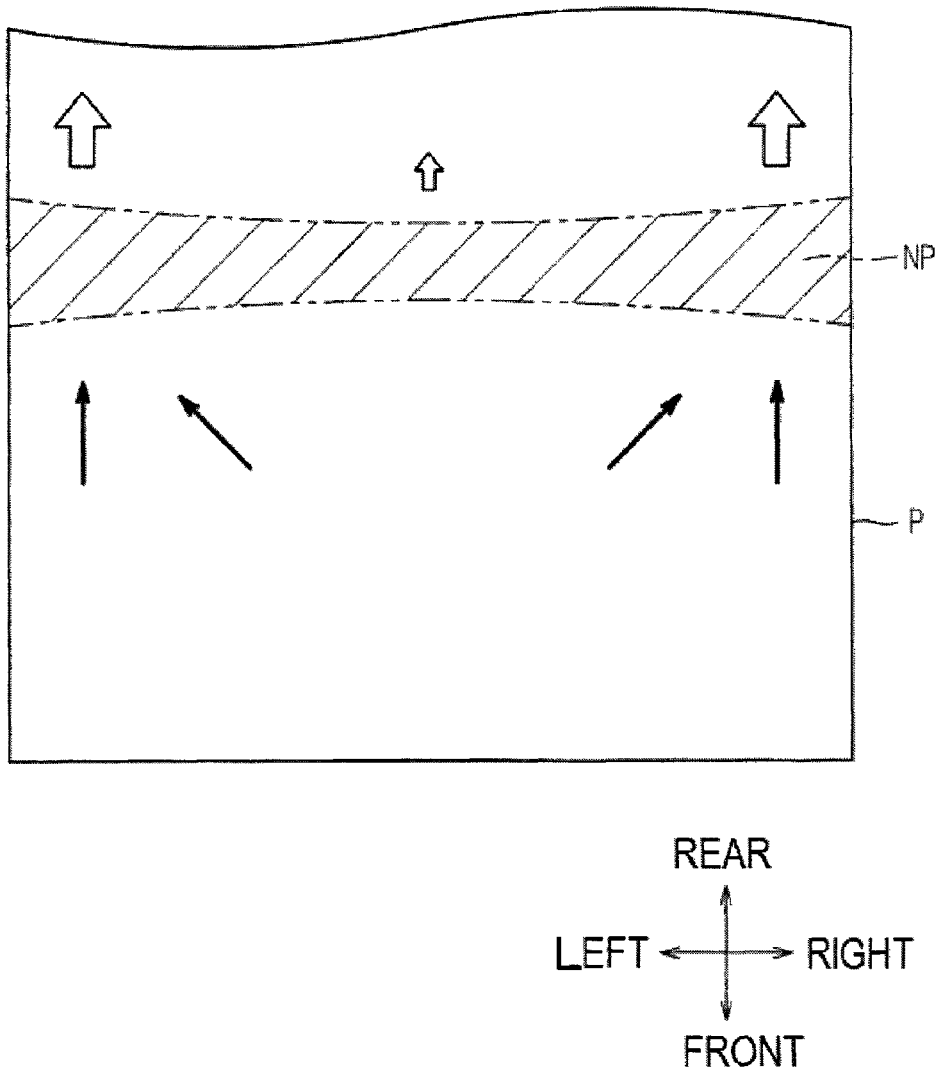
FIG. 5 illustrates a sheet that is conveyed in the fixing device.

The pressing roller 150 is a concave roller in which a diameter of a central portion thereof in the left-right direction is smaller than diameters of both end portions thereof. Specifically, as shown in FIG. 4, the pressing roller 150 has a metal shaft 151 and a rubber layer 152 that covers a periphery of the shaft 151. The shaft 151 has a straight shape having a substantially constant diameter in the left-right direction. The rubber layer 152 has both end portions thicker than a central portion in the left-right direction so that it has a concave shape in which outer diameters of both end portions thereof in the left-right direction is larger than an outer diameter of the central portion thereof.

In the meantime, for example, the rubber layer 152 is manufactured using a mold having a hollow cylindrical cavity. Since the rubber layer 152 can be elastically deformed, it is possible to pull out the rubber layer 152 from the mold even though the rubber layer has the concave shape.

The pressing roller 150 is configured to rotate as a driving force is transferred thereto from a motor (not shown) provided in the body housing 2. As the pressing roller 150 rotates, it rotates the fixing belt 110 by a frictional force with the fixing belt 110 (or sheet P). Thereby, the sheet P having the toner image transferred thereto is conveyed between the pressing roller 150 and the heated fixing belt 110, so that the toner image (toner) is heat-fixed thereon.

Referring back to FIGS. 2 and 3, the stay 160 is a member that supports both end portions of the nip plate 130 in the front-rear direction via the flange parts 142 of the reflection plate 140, thereby securing the rigidity of the nip plate 130. The stay 160 has a shape (substantially U-shaped section) following an outward shape of the reflection plate 140 (reflection part 141) and is disposed to cover the reflection plate 140. The stay 160 is formed by bending a steel plate and the like having relatively high rigidity into a substantially U shape when seen in a cross-sectional view, which is symmetric in the left-right direction.

The stay 160 is disposed above the reflection plate 140 and has an upper wall 161 having a planar shape, a front wall 162 extending downwards from a front end of the upper wall 161 and a rear wall 163 extending downwards from a rear end of the upper wall 161. End faces of lower ends of the front wall 162 and rear wall 163 are support surfaces 164 that support the nip plate 130 and the flange parts 142 of the reflection plate 140.

As shown in FIG. 3, the front wall 162 and the rear wall 163 of the stay 160 are configured so that distances of central portions thereof in the left-right direction from the upper wall 161 to the support surfaces 164 are smaller than distances of both end portions thereof in the left-right direction from the upper wall 161 to the support surfaces 164. That is, the support surface 164 has a curved concave shape in which a central portion thereof in the left-right direction is more spaced from the pressing roller 150 than both end portions thereof in the left-right direction. Here, as an example of the central portion of the support surface 164 in the left-right direction being more spaced from the pressing roller 150 than both end portions thereof in the left-right direction, a distance between the central portion of the support surface 164 and a central axial line of the roller 150 may be greater than distances between both end portions of the support surface and the central axial line of the roller 150 respectively.

The stay 160 may be manufactured, for example, by punching a material so that parts corresponding to the support surfaces 164 of the lower ends of the front wall 162 and rear wall 163 of the stay 160 become desired concave curved surfaces and bending the obtained blank material into a U shape.

Hereinafter, the concave shape of this illustrative embodiment is described.

As shown in FIG. 4, an amount of depression X of the concave shape of the pressing roller 150 is defined as $X=(\Phi A+\Phi B)/2-\Phi C$ where $\Phi A$ and $\Phi B$ are outer diameters of both right and left end portions of the pressing roller 150 and $\Phi C$ is an outer diameter of the central portion of the pressing roller 150. Further, an amount of depression Y of the concave shape of the stay 160 is defined as a distance D between a flat surface and central portions of the front wall 162 and rear wall 163 in the left-right direction when both left and right end portions of the front wall 162 and rear wall 163 of the stay 160 in the left-right direction are placed on the flat surface.

For example, at a state where the pressing roller 150 and the nip plate 130 are spaced from each other, the amount of depression X of the pressing roller 150 is 0.1 to 0.2 mm and the amount of depression Y of the stay 160 is 0 to 0.1 mm. That is, the amount of depression X of the pressing roller 150 is larger than the amount of depression Y of the stay 160.

Note that, in this illustrative embodiment, regarding the pressing roller 150, the straight shape is a shape in which the amount of depression X is smaller than 0.050 mm and the concave shape is a shape in which the amount of depression X is 0.050 mm or larger. Also, in this illustrative embodiment, regarding the stay 160, the straight shape is a shape in which the amount of depression Y is smaller than 0.001 mm and the concave shape is a shape in which the amount of depression Y is 0.001 mm or larger, preferably 0.010 mm or larger, and more preferably 0.050 mm or larger.

According to the above configuration, it is possible to obtain the following operations and effects in this illustrative embodiment.

As shown in FIG. 2, the nip plate 130 and the reflection plate 140 are mounted to the stay 160 so that the flange parts 142 of the reflection plate 140 are pinched by the support surfaces 164 of the stay 160 and the nip plate 130. During the fixing, as shown in FIG. 4, the stay 160 is urged towards the pressing roller 150 by urging members 200 that are provided at both left and right end portions.

At this state, when the halogen lamp 120 becomes ON during the fixing, the nip plate 130 and the flange parts 142 of the reflection plate 140 are deformed to follow the support surfaces 164 of the stay 160 and the central portions thereof in the left-right direction are curved so that they are more spaced from the pressing roller 150 than both end portions thereof.

Thereby, the pressure that is applied between the nip plate 130 and the pressing roller 150 becomes higher at both end portions in the left-right direction than at the central portion in the left-right direction. At this state, when the sheet P is conveyed, a nip area NP of the sheet P, which is positioned between the fixing belt 110 and the pressing roller 150, is more widened in the conveyance direction (front-rear direction) at both end portions than at the central portion in the width direction (left-right direction) of the sheet P. Thereby, the conveying speed of the sheet P becomes faster at both end portions in the left-right direction of the sheet P than at the central portion in the left-right direction of the sheet P. Accompanied by this, a part (an upstream part with respect to the nip area NP) of the sheet P, which enters the nip area NP (between the fixing belt 110 and the pressing roller 150) from now, is tensioned towards both end portions in the left-right direction of the nip area NP, so that the central portion is tightened.

As described above, since the sheet P enters the nip area NP (between the fixing belt 110 and the pressing roller 150) with the central portion thereof in the width direction being tightened, it is possible to reduce wrinkles from being generated on the sheet P.

In addition, the nip plate 130 is curved, and further, the pressing roller 150 is also made to have the concave shape. Thereby, it is possible to reduce the amounts of depression of both the nip plate 130 and the pressing roller 150, compared to a configuration where only the nip plate 130 is curved. As a result, the fixing belt 110 that is pinched by the nip plate 130 and the pressing roller 150 does not deform so much, and can be rotated while keeping the straight state thereof.

In addition, since the pressing roller 150 is heated, the central portion thereof in the left-right direction is expanded and becomes near to the straight shape. Therefore, the amount of depression X of the pressing roller 150 is set to be larger than the amount of depression Y of the stay 160, so that the fixing belt 110, which is pinched between the pressing roller 150 and the nip plate 130, can be rotated without being deformed so much while keeping the straight state, compared to a configuration where the amount of depression Y of the stay 160 is set to be larger than the amount of depression X of the pressing roller 150.

Since the nip plate 130 is deformed and curved while following the shape of the support surfaces 164 of the stay 160, it is possible to easily manufacture the nip plate 130, compared to a configuration where the nip plate 130 is made to have a curved shape in advance.

Although the illustrative embodiment of the invention has been described, the invention is not limited to the illustrative embodiment. The specific configurations can be appropriately changed without departing from the gist of the invention.

Figure 6:
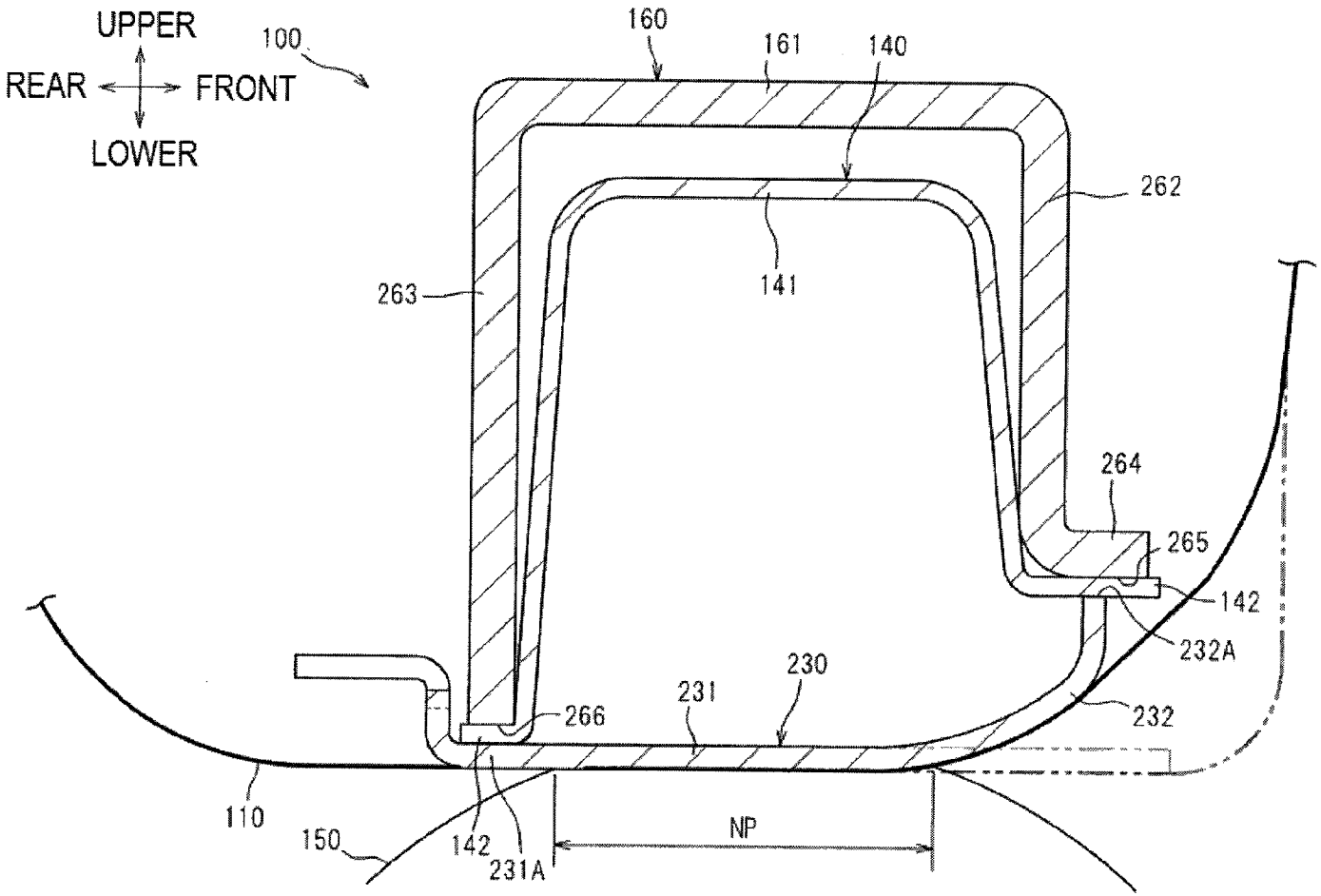
FIG. 6 is a sectional view showing a fixing device according to a modified embodiment.

In the above-described illustrative embodiment, the stay 160 has the substantially U shape that is symmetric in the left-right direction. However, the invention is not limited thereto. For example, as shown in FIG. 6, the stay 160 may have a substantially U shape that is asymmetric in the left-right direction.

Specifically, the stay 160 is configured so that an upper-lower length of a front wall 262 extending downwards from the front end of the upper wall 161 is smaller than an upper-lower length of a rear wall 263 extending downwards from the rear end of the upper wall 161. A lower end portion of the front wall 262 is formed with a flange 264 extending forwards.

The stay 160 is formed with a support surface 265, which is curved so that a central portion thereof in the left-right direction is closer to the upper wall 161 than both end portions thereof in the left-right direction, by bending the flange 264. Further, the stay 160 is formed with a support surface 266, which is curved so that a central portion thereof in the left-right direction is closer to the upper wall 161 than both end portions thereof in the left-right direction, by pressing an end face of a lower end of the rear wall 263.

As described above, the stay 160 is formed to have the substantially U shape that is asymmetric in the left-right direction. Thereby, it is possible to bend upwards the front end portion of a nip plate 230. Specifically, the nip plate 230 has a base part 231 having a planar shape and a curved part 232 that is curved upwards from a front end of the base part 231.

The nip plate 230 is configured so that a rear end portion 231A of the base part 231 is supported to the support surface 266 of the stay 260 via the flange part 142 of the reflection plate 140 and an end face 232A of the curved part 232 is supported to the support surface 265 of the stay 260 viva the flange part 142 of the reflection plate 140.

As described above, the front end portion of the nip plate 230 is curved, so that the stay 160 is formed to have the substantially U shape which is asymmetric in the left-right direction. Thus, compared to a configuration where the nip plate 230 is not provided with the curved part 232 (refer to the dashed-two dotted line), distance between the fixing belt 110 and the pressing roller 150 at the front of the pressing-contact part of the fixing belt 110 and the pressing roller 150, i.e., at the upstream side in the conveyance direction of the sheet P, are increased. Thereby, even when the sheet P is conveyed at any angle, it is easy to guide the sheet between the fixing belt 110 and the pressing roller 150.

In the above-described illustrative embodiment, the nip plate 130 and the flange parts 142 of the reflection plate 140 are configured to be deformed to follow the shape of the support surfaces 164 of the stay 160 and are curved at least during the fixing. However, the invention is not limited thereto. For example, the flange parts of the reflection plate and the nip plate may be formed to have a curved shape where the central portions thereof in the left-right direction are more spaced from the pressing roller 150 than both end portions thereof in the left-right direction in advance.

Further, in the above-described illustrative embodiment, the cylindrical member is made of stainless steel, i.e., metal. However, the invention is not limited thereto. For example, the cylindrical member may be formed of resin.

Further, in the above-described illustrative embodiment, the halogen lamp 120 has been exemplified as the heater. However, the invention is not limited thereto. For example, a carbon heater, an IH heater and the like may be also adopted.

Further, in the above-described illustrative embodiment, the sheet P such as normal sheet, postcard and the like has been exemplified as the recording sheet. However, the invention is not limited thereto. For example, an OHP sheet may be also used.

What is claimed is:

1. A fixing device comprising:

a flexible cylindrical member;

a heater that is disposed inside the cylindrical member;

a nip plate configured to be in contact with an inner peripheral surface of the cylindrical member and configured to be heated by the heater;

a roller configured to pinch the cylindrical member between the roller and the nip plate; and a stay disposed at one side of the nip plate opposite another side of the nip plate where the roller is provided, the stay including a support surface supporting the nip plate and having a curved shape, with a central portion thereof in an axial direction being more spaced from the roller than both end portions thereof in the axial direction to provide a first depression amount;

wherein, at least during fixing, the nip plate has a curved shape where a central portion thereof in an axial direction of the cylindrical member is more spaced from the roller than both end portions thereof in the axial direction, and wherein the roller is a concave roller where a diameter of a central portion thereof in the axial direction is smaller than diameters of both end portions thereof respectively to provide a second depression amount, the second depression amount being greater than the first depression amount.

2. The fixing device according to claim 1, wherein the nip plate has the curved shape by being deformed to follow the shape of the support surface.

3. The fixing device according to claim 1, wherein the stay has a substantially U shape that is asymmetric, when seen in the axial direction.

4. The fixing device according to claim 1, wherein the heater is a heating element configured to emit radiation heat, wherein a reflection plate configured to reflect the radiation heat from the heater towards the nip plate is provided between the heater and the stay, wherein the reflection plate has a supported part that is pinched between the nip plate and the stay, and wherein, at least during fixing, the supported part has a curved shape where a central portion thereof in the axial direction is more spaced from the roller than both end portions thereof in the axial direction.

5. The fixing device according to claim 1, wherein the cylindrical member is made of metal.

6. The fixing device according to claim 1, wherein the roller has a metal shaft and a rubber layer that covers a periphery of the shaft, and wherein the shaft has a straight shape.

7. A thermal fixing device comprising:

an endless belt defining a first axial line extending in a first direction;

a nip plate disposed inside the endless belt and including a central portion in the first direction and first and second end portions in the first direction, the first end portion of the nip plate being an end portion of the nip plate in the first direction and the second end portion of the nip plate being an opposite end portion of the first end portion in the first direction;

a roller defining a second axial line and opposed to an outer surface of the endless belt in a second direction perpendicular to the first direction, the roller configured to pinch the endless belt between the roller and the nip plate and including a central portion in the first direction and first and second end portions in the first direction, the first end portion of the roller being an end portion of the roller in the first direction and the second end portion of the roller being an opposite end portion of the first end portion in the first direction; and a stay that is disposed at one side of the nip plate opposite to another side of the nip plate where the roller is provided and includes a support surface supporting the nip plate and including a central portion in the first direction and first and second end portions in the first direction, wherein the first end portion of the support surface being an end portion of the support surface in the first direction and the second end portion of the support surface being an opposite end portion of the first end portion in the first direction, wherein the support surface has a curved shape such that a distance between the central portion of the support surface and the second axial line in the second direction is greater than a distance between the first end portion of the support surface and the second axial line in the second direction, and the distance between the central portion of the support surface and the second axial line in the second direction is greater than a distance between the second end portion of the support surface and the second axial line in the second direction, to provide a first depression amount, wherein the nip plate is configured to have a curved shape such that a distance between the central portion of the nip plate and the second axial line in the second direction is greater than a distance between the first end portion of the nip plate and the second axial line in the second direction, and the distance between the central portion of the nip plate and the second axial line in the second direction is greater than a distance between the second end portion of the nip plate and the second axial line in the second direction, and wherein the roller is a concave roller where a diameter of a central portion of the roller is smaller than a diameter of the first end portion of the roller, and the diameter of the central portion of the roller is smaller than a diameter of the second end portion of the roller to provide a second depression amount, the second depression amount being greater than the first depression amount.

8. The thermal fixing device according to claim 7, wherein the nip plate has the curved shape by being deformed to follow the shape of the support surface.

9. The thermal fixing device according to claim 7, wherein the stay has a substantially U shape that is asymmetric, when seen in the first direction.

10. The thermal fixing device according to claim 7, further comprising a heater, wherein the heater is a heating element configured to emit radiation heat, wherein a reflection plate configured to reflect the radiation heat from the heater towards the nip plate is provided between the heater and the stay, wherein the reflection plate has a supported part that is pinched between the nip plate and the stay, wherein the supported part includes a central portion in the first direction and first and second end portions in the first direction, the first end portion of the supported part being an end portion of the supported part in the first direction, the second end portion of the supported part being an opposite end portion of the first end portion in the first direction, and wherein the supported part is configured to have a curved shape such that a distance between the central portion of the supported part and the second axial line in the second direction is greater than a distance between the first end portion of the supported part and the second axial line in the second direction, and the distance between the central portion of the supported part and the second axial line in the second direction is greater than a distance between the second end portion of the supported part and the second axial line in the second direction.

11. The thermal fixing device according to claim 7, wherein the endless belt includes a metal layer.

12. The thermal fixing device according to claim 7, wherein the roller has a metal shaft and a rubber layer that covers a periphery of the shaft, and wherein the shaft has a straight shape.

13. A thermal fixing device comprising:

an endless belt defining a first axial line extending in a first direction;

a nip plate disposed inside the endless belt and including a central portion in the first direction and an end portion in the first direction;

a heater configured to heat the endless belt;

a roller defining a second axial line and opposed to an outer surface of the endless belt in a second direction perpendicular to the first direction, the roller configured to pinch the endless belt between the roller and the nip plate and including a central portion in the first direction and an end portion in the first direction; and a stay disposed at one side of the nip plate opposite to another side of the nip plate where the roller is provided and including a support surface supporting the nip plate and including a central portion in the first direction and an end portion, wherein the support surface has a curved shape such that a distance between the central portion of the support surface and the second axial line in the second direction is greater than a distance between the end portion of the support surface and the second axial line in the second direction to provide a first depression amount, wherein the nip plate is configured have a curved shape such that a distance between the central portion of the nip plate and the second axial line in the second direction is greater than a distance between the end portion of the nip plate and the second axial line in the second direction, and wherein the roller is a concave roller where a diameter of a central portion of the roller is smaller than a diameter of the end portion of the roller to provide a second depression amount, the second depression amount being greater than the first depression amount.

14. The thermal fixing device according to claim 13, wherein the nip plate has the curved shape by being deformed to follow the shape of the support surface.

15. The thermal fixing device according to claim 13, wherein the stay has a substantially U shape that is asymmetric, when seen in the first direction.

16. The thermal fixing device according to claim 13, wherein the heater is a heating element configured to emit radiation heat, wherein a reflection plate configured to reflect the radiation heat from the heater towards the nip plate is provided between the heater and the stay, wherein the reflection plate has a supported part that is pinched between the nip plate and the stay, wherein the supported part includes a central portion in the first direction and an end portion in the first direction, and wherein the supported part is configured to have a curved shape such that a distance between the central portion of the supported part and the second axial line in the second direction is greater than a distance between the end portion of the supported part and second axial line in the second direction.

17. The thermal fixing device according to claim 13, wherein the endless belt includes a metal layer.

18. The thermal fixing device according to claim 13, wherein the roller has a metal shaft and a rubber layer that covers a periphery of the shaft, and wherein the shaft has a straight shape.

* * * * *